US006464019B1

(12) United States Patent
Werner et al.

(10) Patent No.: US 6,464,019 B1
(45) Date of Patent: Oct. 15, 2002

(54) PERFORATING CHARGE CASE

(75) Inventors: Andrew T. Werner, East Bernard; Brenden M. Grove, Missouri City, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 28 days.

(21) Appl. No.: 09/708,914

(22) Filed: Nov. 8, 2000

(51) Int. Cl.[7] ..... E21B 43/117

(52) U.S. Cl. ..... 175/4.6; 86/47; 102/307; 102/476; 264/3.4

(58) Field of Search ..... 175/4.6; 86/47; 102/306–309, 476; 264/3.4; 419/38

(56) References Cited

U.S. PATENT DOCUMENTS 4,043,266 A * 8/1977 Held
4,297,946 A * 11/1981 Paton et al.
4,766,813 A * 8/1988 Winter et al.
5,279,228 A * 1/1994 Ayer
5,509,356 A * 4/1996 Renfro

* cited by examiner

*Primary Examiner*—Roger Schoeppel
(74) *Attorney, Agent, or Firm*—Trop, Pruner & Hu, P.C.; Jeffrey E. Griffin; Brigitte Jeffery

(57) ABSTRACT

A perforating charge case is made by a process that includes cold forming a material into a shape for the perforating charge case. The cold forming produces additional recrystallization nucleation sites in the material. After the cold forming, the material may be annealed to decrease sizes of grains of the material to improve a ductility of the material to increase fragment sizes of the perforating charge case when an explosive that is placed inside the perforating charge case detonates.

47 Claims, 4 Drawing Sheets

PERFORATING CHARGE CASE

BACKGROUND

The invention generally relates to a perforating charge case.

Perforating charges are small explosive devices that are used to create holes in an oil well casing and tunnels into a petroleum-bearing formation for purposes of establishing the flow of formation fluids into the casing. Referring to a cross-sectional view of a perforating charge 2 in FIG. 1, the perforating charge 2 typically includes three basic components: 1. a cup-shaped metallic case 4 that circumscribes an axis 1; 2. a liner 6 that resides inside the case 4, is generally metallic and typically is conical about the axis 1; and 3. an explosive 5 that is located inside the case 4 between the bottom of the case 4 and the liner 6 so that the explosive 5 surrounds the liner 6 on the liner's outer convex surface. The perforating charge 2 may include a connector 3 to secure a detonating cord to the perforating charge case 4.

When the explosive 5 detonates, the explosive 5 collapses the liner 6 inwardly onto the axis 1 and forces the collapsed liner 6 toward the open end of the case 4 toward the rock formation to form a perforating jet. The perforating jet forms a hole in the well casing and a tunnel in the formation. Simultaneous to the formation of the perforating jet, the detonating explosive 5 expands the charge case 4 radially away from the axis 1 until the case 4 fragments into several pieces. The breakup characteristics of the case 4, such as the size and number of fragments of the case 4, depends on several factors, primary among these being the mechanical properties of the case material itself. The charge case 4 typically may be fabricated from steel, but as explained below, the case 4 may also be formed from die-cast zinc. Charge case fragments are generally termed "case debris," or more generally, "charge debris."

Several perforating charges may be spatially arranged in a pattern (a spiral pattern, for example) in a device called a perforating gun. The perforating charges are generally ballistically connected via a detonating cord or some other means. In general, two types of perforating guns exist: 1. a hollow carrier perforating gun 10 (see FIG. 2) that typically includes a steel pipe 12 that houses radially oriented perforating charges 14 and isolates the perforating charges 14 from the wellbore environment before detonation; and 2. a capsule gun (not shown) that is essentially a metallic strip or similar device onto which the charges are attached and are exposed to the wellbore environment before detonation. Referring to FIG. 3, for the hollow carrier perforating gun 10, the perforating charges 14 create several exit holes 16 in the pipe 12 when detonated. The diameter of each exit hole 16 may be about one fourth to one half inches, depending on the characteristics of the perforating charges 14 and other factors.

In a vertical well, one historical advantage of the hollow carrier perforating gun 10 is that essentially all case debris is retained inside the gun 10. Small quantities of case fragments may escape the hollow carrier perforating gun 10 through the exit holes 16 immediately after charge detonation, but most debris settles to the bottom of the gun 10. After detonation, the hollow carrier perforating gun 10 may be retrieved from the vertical wellbore via a wireline or some other arrangement. Some of the case debris may be small enough to fit through the exit holes 16, however, no mechanism exists to expel large quantities of this debris through the exit holes 16. Any debris that does exit the hollow carrier perforating gun 10 through the exit holes 14 falls under gravity into the "rathole" below the gun 10 to the bottom of the wellbore.

In highly deviated or horizontal wells, however, the situation may be quite different. In this manner, many modern completions employ "extended reach," or very long horizontal sections, that are perforated. Therefore, during and after perforating, the hollow carrier perforating gun 10 is horizontal. After perforating, the hollow carrier perforating gun 10 typically is retrieved to the surface after being dragged along a significant length of horizontal wellbore. During this retrieval, random rotation of the hollow carrier perforating gun 10 may occur. All this contributes to the significantly increased likelihood that charge debris may escape from the gun exit holes 16. Not only may more debris enter the wellbore than in a vertical well, the debris may create more significant problems than would be encountered in a vertical well. More specifically, the debris may "bridge" in the well casing, causing the hollow carrier perforating gun 10 to get stuck during its retrieval; debris may fall into (and block production from) any perforations on the lower side of the well casing; and any debris that does flow toward the surface may collect at bends or "heels" in the well casing, for example, where a horizontal section of the well casing meets a vertical section. Also, any debris that flows through the well may cause significant damage to both downhole and surface equipment (valves, for example).

For purposes of addressing the debris problem, die-cast zinc may be used as a replacement for steel as a material to form the charge case 4. In this manner, zinc is more effectively pulverized than steel, and any zinc debris may be dissolved with acid treatment. While successful overall, a number of difficulties may be associated with zinc charge cases: 1. for a given design, charge performance is often sacrificed; 2. for a given sufficient exposure time, the zinc debris is known to react with certain completion fluids ($CaCl_2$, etc.), forming a hard cement that adversely affects the completion; 3. the zinc alloys typically used may lead to significant energy-liberating reactions that lead to observed "gun shock" and cause significant damage to completions and equipment; and 4. zinc liquid/vapor that is deposited on the gun carrier inner wall during carrier strain or deformation may lead to liquid-metal embrittlement and increase the likelihood of gun failure (splitting of the gun, for example).

Thus, there is a continuing need for a perforating charge case that addresses one or more of the problems that are stated above.

SUMMARY

In an embodiment of the invention, a perforating charge case is made by a process that includes forming a material into a shape for the perforating charge case and annealing the material.

In another embodiment of the invention, a perforating charge case is made by a process that includes cold forming a material into a shape for the perforating charge case. The cold forming produces additional recrystallization nucleation sites in the material. After the cold forming, the material may be annealed to decrease sizes of grains of the material to improve a ductility of the material to increase fragment sizes of the perforating charge case when an explosive that is placed inside the perforating charge case detonates.

In some embodiments of the invention, the charge case may be formed at least partially from copper, and in some embodiments of the invention, the charge case may be formed at least partially from a superplastic material.

Advantages and other features of the invention will become apparent from the following description, drawing and claims.

DETAILED DESCRIPTION

Figure 1:
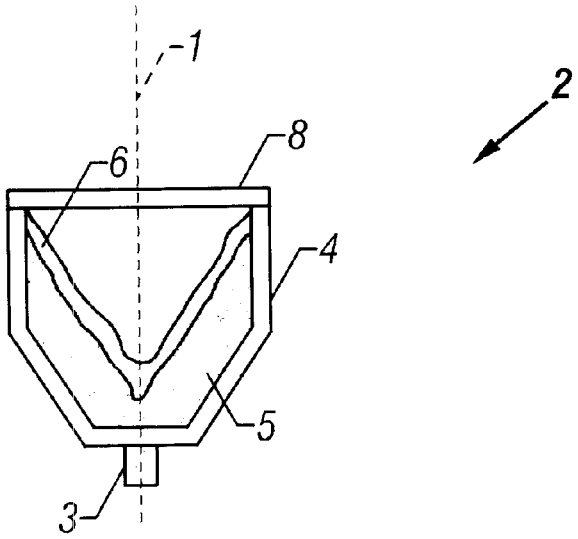
FIG. 1 (Prior Art)
FIG. 1 is a cross-sectional view of a perforating charge case of the prior art.
Figure 2:
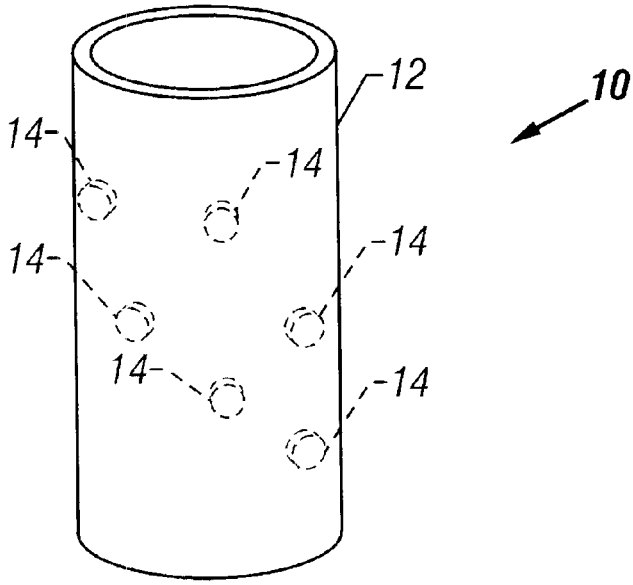
FIG. 2 (Prior Art)
FIG. 2 is a perspective view of a hollow carrier perforating gun of the prior art before detonation.
Figure 3:
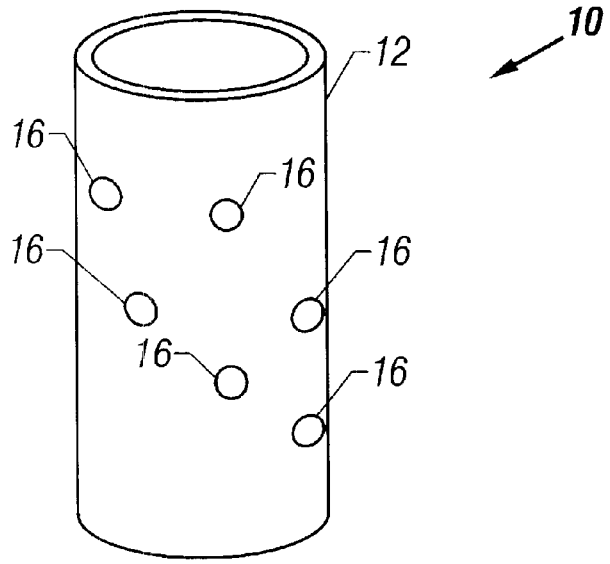
FIG. 3 (Prior Art)
FIG. 3 is a perspective view of a hollow carrier perforating gun of the prior art after detonation.
Figure 4:
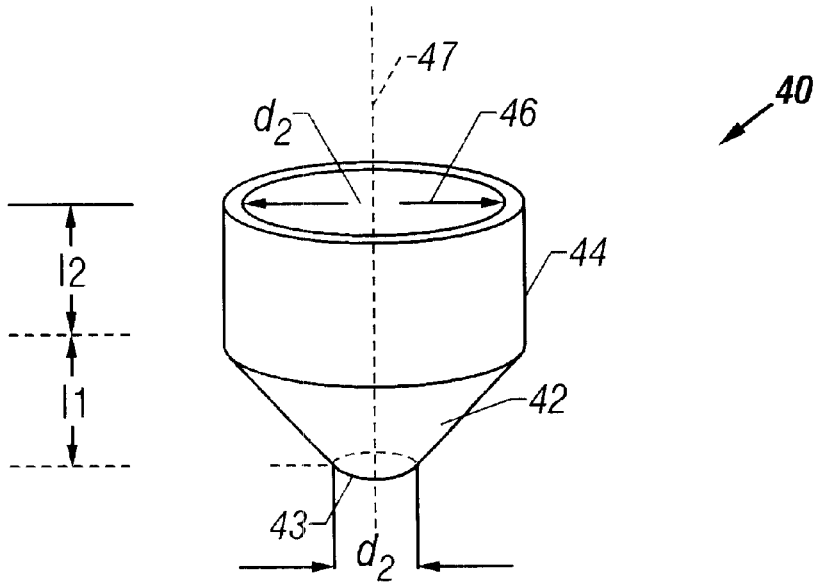
FIGS. 4 and 7 are perspective views of charge cases according to different embodiments of the invention.
Figure 6:
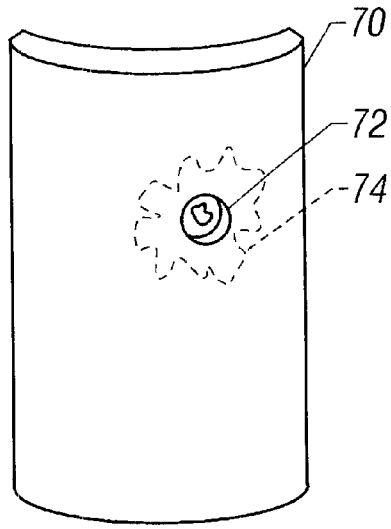
FIG. 6 is a schematic diagram illustrating a portion of a hollow carrier perforating gun after detonation of a perforating charge according to an embodiment of the invention.

Referring to FIG. 4, an embodiment 40 of a perforating charge case in accordance with the invention fragments into only a few, very large pieces that are more unlikely to escape the exit holes of a hollow carrier perforating gun than fragments that are created by conventional charge cases. For example, for the case of a hollow carrier perforating gun, FIG. 6 depicts one 74 of only a few large fragments that are formed when a perforating charge that uses the perforating charge case 40 detonates. As illustrated, the fragment 74 remains inside an outer carrier pipe 70 of the perforating gun and thus, does not travel through an exit hole 72 that is formed by the perforation jet.

Due to its fragmentation characteristics, the perforating charge case 40 may offer one or more of the following advantages. The downhole debris, if any, that is created by the perforating charge case is minimized. The debris from the perforating charge case 40 may be recovered when the perforating gun is retrieved to the surface of the well. The perforating charge case 40 does not adversely affect the completion performance. The perforating charge case 40 does not cause the carrier pipe of a hollow carrier perforating gun to split. Thus, the perforating charge case 40 addresses the debris problem with at least the same success as zinc, without any of the accompanying drawbacks that are associated with zinc. Other and different advantages may be possible in different embodiments of the invention.

The fragmentation characteristics of the perforating charge case 40 is attributable to the material that forms the perforating charge case 40 and a technique (described 10 below) that is used to impart the desired characteristics into the material. More particularly, in some embodiments of the invention, the charge case 40 is formed from a material that exhibits high dynamic ductility and a density equal to or greater than that of steel. Such ductility permits the charge case 40 to expand more than conventional charge cases, thereby creating fewer and larger case material fragments. These materials may include, as examples, alloys and tempers of copper that are processed as described below. As an example, the charge casing may be made from a copper or copper alloy. For example, some of these coppers and alloys include C10100 oxygen free copper, C11000 electrolytic tough pitch copper, and C65500 silicon bronze. The C10100 and C11000 materials are essentially pure copper (approximately 99.90% or greater copper), with trace amounts of additives that may enhance machining of the copper or other properties. Materials other than copper may be used, as noted below. In general, regardless of the material that is used to form the charge case, the material has a ductility approximately greater than 5%, in some embodiments of the invention. In other embodiments of the invention, the ductility may be approximately greater than 10%, may be approximately greater than 20%, and may be greater than 200%, as just a few examples.

The purity of the material is a significant factor that governs the dynamic ductility that may be achieved, as inclusions (oxygen inclusions, for example) in the material provide microvoid nucleation sites leading to ductile fracture, thus decreasing the dynamic ductility of the charge case 40.

Figure 5:
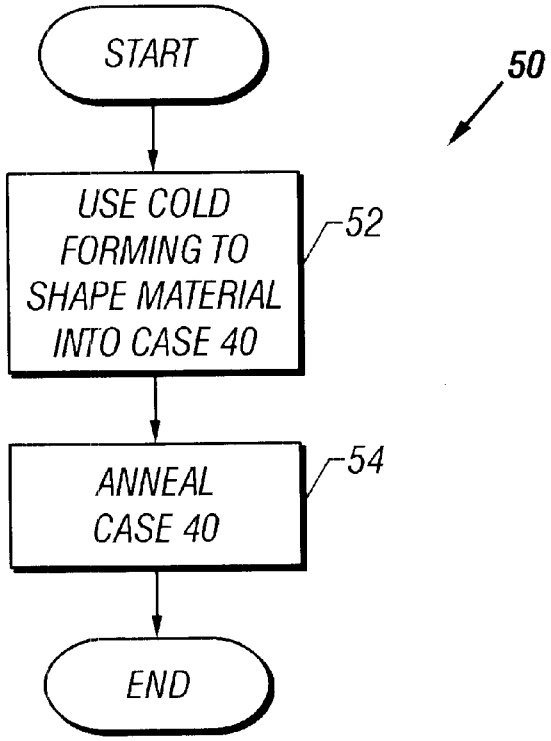
FIG. 5 is a flow diagram depicting a technique to make the charge case of FIG. 4 according to an embodiment of the invention.

The dynamic ductility of the above-described materials may be further increased by a technique 50 that is depicted in FIG. 5. In this manner, it has been discovered that by forging, or cold forming (block 52), these materials, additional recrystallization nucleation sites are established in the material. As example, a single piece of material may be forged to create the perforating charge case 40 in the general shape (described in more detail below) that is depicted in FIG. 4. The cold forming results in less scrap material that is left over when the charge case 40 is manufactured, thereby resulting in a less expensive technique to make the charge case 40, as compared to machining, for example. Furthermore, the use of cold forming may result in increased strength for the case 40. This additional strength may be needed to withstand the loading forces that may be used to press a perforating charge explosive and perforating charge liner (the explosive and liner are not shown) into the perforating charge case 40.

As noted above, the cold forming increases the number of recrystallization nucleation sites from which additional grains may be formed in the case material when the case 40 is annealed (block 54), another part of the technique that is depicted in FIG. 5. As an example, the case 40 may be heated to an appropriate recrystallization temperature (for example, 750 to 900° Fahrenheit (F) for copper) for a time interval approximately in the range of 15 min. to 1 hour, depending on the particular embodiment. The annealing recrystalizes the casing material to impart generally finer, or smaller, sizes to grains of the material, as compared to the sizes of the grains of the casing material before application of the technique 50. The smaller grain size of the material, in turn, increases the dynamic ductility of the case 40 so that the case 40 does not fragment into small pieces when the perforating charge detonates.

In some embodiments of the invention, the explosive may be compressed into an explosive pellet to eliminate the need to compress loose explosive powder placed in the charge case 40, thereby reducing the amount of loading on the charge case 40.

Experiments were conducted to examine the debris created by the charge case 40 when an explosive inside the case 40 detonates. A copper alloy was used in these experiments as the material for the charge case 40. The data from these experiments demonstrates a significant improvement in case breakup characteristics, as compared to a steel case (of similar design) that was not processed by the technique 50. When screened through standard sieves, the mass percentage of charge case debris collected when using the charge case 40 was significantly larger than the gun exit hole size and had an average size that was a factor of two to three times larger than the size of fragments formed from steel charge cases. This data shows that the quantity of debris that is capable of exiting the gun is reduced by more than half. These tests neglect in-gun bridging effects that further reduce the amount of debris that is capable of exiting the gun carrier when the charge case 40 is used.

Other materials may be used in place of copper or copper alloys for the casing material. These casing materials include other high-density ductile materials that generally exhibit a face-centered-cubic (FCC) crystal structure. These materials include numerous other copper and nickel alloys, as just a few examples. As other examples, nickel, lead, gold or silver may also be used as materials that, when the technique 50 is used, possess the dynamic ductility that is needed to cause the charge case 40 to fragment into large pieces of debris.

Referring back to FIG. 4, as another example of a possible shape of the case 40 (although other shapes are possible), the charge case 40 may generally circumscribe an axis 47 and be formed from a generally circularly cylindrical section 44 (that circumscribes the axis 47) and a generally conical section 42 (that circumscribes the axis 47). In this manner, the smaller diameter end of the generally conical section 42 may be closed off by an end 43 that forms the bottom of the charge case 40; and its larger diameter end, the generally conical section 42 transitions into the generally circularly section 44 at one end of the section 44. The other end of the section 44 forms an open end 46 that receives a case cap (not shown). As noted above, the charge case 40 may be cold formed. For example, a forging tool that has a die in the shape that is depicted in FIG. 4 may be used to stamp out the shape from a piece of material.

Other embodiments of the invention are within the scope of the following claims. For example, the shape of the case 40 may be formed by machining the charge case material.

Figure 7:
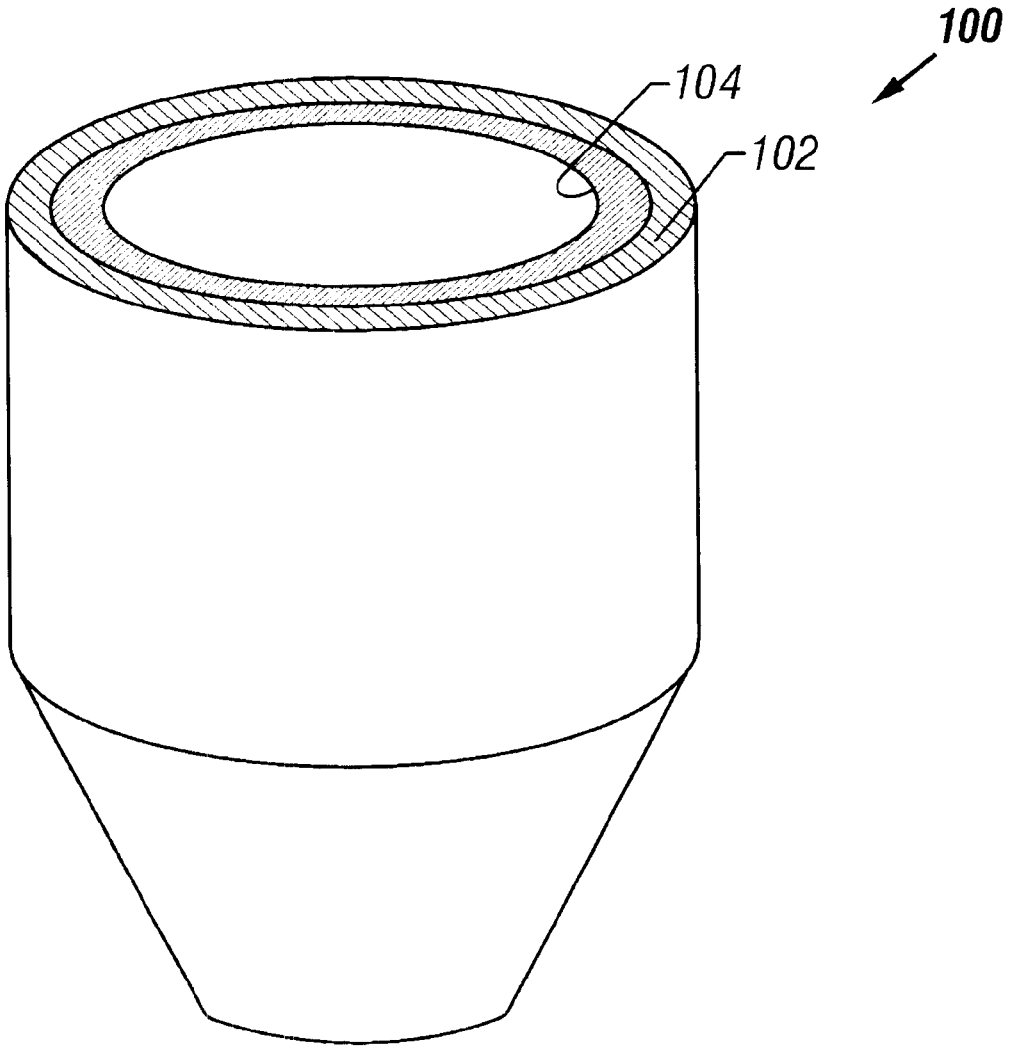

As another example of another embodiment of the invention, more than one material may be used to form multiple layers of the charge case 40. As a more specific example, one material that has a relatively low dynamic ductility may be used to strengthen the case, and another material that has a high dynamic ductility may be used for purposes of increasing the fragment sizes of the case debris. In this manner, FIG. 7 depicts a charge case 100 that is formed from an inner material 104 (of an inner layer) that is contoured to the general shape of the charge case 100 and provides structural support for the charge case 100. The inner material 104 is surrounded by an outer material 102 (of an outer layer) that is contoured to the general shape of the charge case 100 and exhibits a high dynamic ductility. The inner 104 and outer 102 materials may or may not be bonded or laminated together. The inner 104 and outer 102 materials may form a composite material. As a more specific example, the inner material 104 may be steel, and the outer material 102 may be a copper or copper alloy (as examples) that is formed by the technique 50. The copper material may be thicker than the steel material, in some embodiments of the invention. Thus, the outer material 102 limits the fragmentation of the inner material 104, and the inner material 104 provides strength to supplement the strength of the outer material 102. Other materials may be used for the inner 104 and outer 102 materials, and the charge case may include more than two material layers, in other embodiments of the invention.

As yet another example of an additional embodiment of the invention, the charge case may be made partially or totally out of a superplastic material. A superplastic material exhibits high elongation or deformation without fracturing or breaking. The superplastic material may be a metal (such as aluminum, copper, titanium, magnesium, or other light metals) or some other suitable material. Some superplastic materials may exhibit superplastic characteristics at about 95% to 100% of the melting temperature of the material. Other superplastic materials may exhibit superplastic characteristics at other temperature ranges, such as greater than about 50% of the melting temperature. Thus, depending on the desired application, the superplastic material selected may be one that exhibits superplastic characteristics at a desired temperature range. This temperature range includes the temperature that the superplastic material reaches when the explosive of the perforating charge detonates. In other embodiments, other highly deformable materials that exhibit the desired deformation characteristics at a selected temperature while still maintaining structural integrity (e.g., without breaking or fracturing) may be used as a material for the charge case.

A superplastic material is a polycrystalline solid that has the ability to undergo large plastic strains prior to failure. For deformation in uni-axial tension, elongation to failure in excess of 200% are usually indicative of superplasticity. For superplastic behavior, a material must be capable of being processed into a fine equi-axed grain structure that will remain stable during deformation. The grain size of superplastic materials are made as small as possible, normally in the range of 2 to 10 micrometers, although materials with larger grain sizes may also exhibit superplasticity.

The superplastic material may be used to form all or part of the charge case in some embodiments of the invention. Furthermore, in some embodiments of the invention, the superplastic material may be used to form all or part of a layer of a multiple layer charge case. Other arrangements are possible.

Other embodiments are within the scope of the claims. For example, in some embodiments of the invention, the case charge may be cold-formed and/or machined only without annealing the case charge material. In this manner, sufficiently high dynamic ductility may be achieved without annealing the charge case material.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A perforating charge case made by a process comprising:

forming a material into a shape for the perforating charge case; and annealing the material.

2. The perforating charge case of claim 1, wherein the annealing occurs after the forming.

3. The perforating charge case of claim 1, wherein the forming comprises cold forming.

4. The perforating charge case of claim 1, wherein the forming comprises:

machining the material into the shape.

5. The perforating charge case of claim 1, wherein the process further comprises:

lining the material with another material to increase a strength of the perforating charge case.

6. The perforating charge case of claim 1, wherein the material has a purity of approximately 99.90% or greater.

7. The perforating charge case of claim 1, wherein the material comprises a material selected from a set consisting essentially of: oxygen free copper electrolytic tough pitch copper and silicon bronze.

8. The perforating charge case of claim 1, wherein the material comprises a material selected from a set consisting essentially of: nickel, nickel alloy, gold, gold alloy, silver, silver alloy, lead, lead alloy, copper, copper alloy and superplastic materials.

9. The perforating charge case of claim 1, wherein the material has a face-centered-cubic structure.

10. The perforating charge case of claim 1, wherein the annealing comprises:

heating the material to a temperature in a range of approximately 750 to 900 degrees Fahrenheit.

11. The perforating charge case of claim 1, wherein the annealing comprises:

heating the material during a time interval in a range of approximately fifteen minutes to one hour.

12. The perforating charge case of claim 1, wherein the annealing increases a ductility of the charge case.

13. A method for forming a perforating charge case, comprising:

forming a material into a shape for the perforating charge case; and annealing the material.

14. The method of claim 13, wherein the annealing occurs after the forming.

15. The method of claim 13, wherein the forming comprises cold forming.

16. The method of claim 13, wherein the forming comprises:

machining the material into the shape.

17. The method of claim 13, further comprising:

lining the material with another material to increase a strength of the perforating charge case.

18. The method of claim 13, wherein the material has a purity of approximately 99.90% or greater.

19. The method of claim 13, wherein the material comprises a material selected from a set consisting essentially of: oxygen free copper, electrolytic tough pitch copper and silicon bronze.

20. The method of claim 13, wherein the material comprises a material selected from a set consisting essentially of: nickel, nickel alloy, gold, gold alloy, silver, silver alloy, lead, lead alloy, copper, copper alloy and superplastic materials.

21. The method of claim 13, wherein the material has a face-centered- cubic structure.

22. The method of claim 13, wherein the annealing comprises:

heating the material to a temperature in a range of approximately 750 to 900 degrees Fahrenheit.

23. The method of claim 13, wherein the annealing comprises:

heating the material during a time interval in a range of approximately fifteen minutes to one hour.

24. The method of claim 13, wherein the annealing increases a ductility of the charge case.

25. A perforating charge case made by a process comprising:

cold forming a material into a shape for the perforating charge case, the cold forming producing additional recrystallization nucleation sites in the material; and after the cold forming, annealing the material to decrease sizes of grains of the material to improve a ductility of the material to increase fragment sizes of the perforating charge case when an explosive that is placed inside the perforating charge case detonates.

26. The perforating charge case of claim 25, wherein the annealing occurs after the forming.

27. The perforating charge case of claim 25, wherein the process further comprises:

lining the material with another material to increase a strength of the perforating charge case.

28. The perforating charge case of claim 25, wherein the material has a purity of approximately 99.90% or greater.

29. The perforating charge case of claim 25, wherein the material comprises a material selected from a set consisting essentially of: oxygen free copper, electrolytic tough pitch copper and silicon bronze.

30. The perforating charge case of claim 25, wherein the material comprises a material selected from a set consisting essentially of: nickel, nickel alloy, gold, gold alloy, silver, silver alloy, lead, lead alloy, copper, copper alloy and superplastic materials.

31. A method comprising:

cold forming a material into a shape for the perforating charge case, the cold forming producing additional recrystallization nucleation sites in the material; and after the cold forming, annealing the material to decrease sizes of grains of the material to improve a ductility of the material to increase fragment sizes of the perforating charge case when an explosive that is placed inside the perforating charge case detonates.

32. The method of claim 31, wherein the annealing occurs after the forming.

33. The method of claim 31, further comprising:

lining the material with another material to increase a strength of the perforating charge case.

34. The method of claim 31, wherein the material has a purity of approximately 99.90% or greater.

35. The method of claim 31, wherein the material comprises a material selected from a set consisting essentially of: oxygen free copper, electrolytic tough pitch copper and silicon bronze.

36. The method of claim 31, wherein the material comprises a material selected from a set consisting essentially of: nickel, nickel alloy, gold, gold alloy, silver, silver alloy, lead, lead alloy, copper and copper alloy.

37. A shaped charge, comprising a case, at least a portion of which is made from a copper having a fine grain size.

38. A shaped charge, comprising a case, at least a portion of which is made from a copper that is substantially free of inclusions, oxides, defects and fracture recrystallization nucleation sites.

39. A shaped charge, comprising:

a case at least a portion of which is formed of a superplastic material.

40. The shaped charge of claim 39, wherein approximately all of the case is formed from the superplastic material.

41. The shaped charge of claim 39, wherein the superplastic material forms one of multiple layers of the case.

42. A shaped charge, comprising:

a case at least a portion of which is formed of a material having a ductility above approximately five percent.

43. The shaped charge of claim 42, wherein the material comprises one selected from a set consisting essentially of: nickel, nickel alloy, gold, gold alloy, silver, silver alloy, lead, lead alloy, copper, copper alloy and superplastic materials.

44. The shaped charge of claim 42, wherein the ductility is greater than approximately 10 percent.

45. The shaped charge of claim 42, wherein the ductility is greater than approximately 20 percent.

46. The shaped charge of claim 42, wherein the ductility is greater than approximately 200 percent.

47. A shaped charge, comprising a case, at least a portion of which has at least one layer formed of copper.

* * * * *